United States Patent [19]

Cornelissens

[11] 4,234,442

[45] Nov. 18, 1980

[54] FEED UNIT OF A DETERGENT COMPOSITION BASED ON ALKALI CARBONATE

[75] Inventor: Emery G. P. Cornelissens, Nootdorp, Netherlands

[73] Assignee: Akzo N.V., Netherlands

[21] Appl. No.: 924,551

[22] Filed: Jul. 14, 1978

[51] Int. Cl.[2] ..... C11D 7/08; C11D 7/12; C11D 17/00; C11D 17/04

[52] U.S. Cl. ..... 252/90; 8/137; 134/26; 134/27; 134/28; 252/92; 252/134; 252/142; 252/156; 252/174; 252/188.3 R; 206/524.1; 206/524.7

[58] Field of Search ..... 252/90, 91, 92, 93, 252/134, 174, 188.3 R, 70, 142; 8/137; 134/26, 27, 28; 206/524.7, 524.1

[56] References Cited

U.S. PATENT DOCUMENTS

| | | | |
|---|---|---|---|
| 2,470,851 | 5/1949 | Hermanson | 252/93 |
| 2,817,606 | 12/1957 | Barrett | 134/22 |
| 3,042,621 | 7/1962 | Kirschenbauer | 252/99 |
| 3,042,622 | 7/1962 | Kirschenbauer | 252/99 |
| 3,300,546 | 1/1967 | Baechtold | 252/90 X |
| 3,528,921 | 9/1970 | Gray | 252/99 |
| 3,634,260 | 1/1972 | Pickin | 252/90 X |
| 3,761,415 | 9/1973 | Gould | 252/142 |
| 3,968,048 | 7/1976 | Bolan | 252/157 |
| 3,997,459 | 12/1976 | Bogie | 252/99 |
| 4,028,262 | 6/1977 | Cheng | 252/89 |
| 4,093,417 | 6/1978 | Heinlein | 8/137 |
| 4,155,868 | 5/1979 | Kaplan | 252/95 |

FOREIGN PATENT DOCUMENTS

| | | | |
|---|---|---|---|
| 867039 | 11/1978 | Belgium | 252/90 |
| 1000628 | 11/1976 | Canada | 252/91 |
| 1617163 | 2/1971 | Fed. Rep. of Germany . | |
| 2437173 | 2/1976 | Fed. Rep. of Germany . | |
| 2820966 | 11/1978 | Fed. Rep. of Germany | 252/90 |

*Primary Examiner*—Dennis L. Albrecht
*Attorney, Agent, or Firm*—Stevens, Davis, Miller & Mosher

[57] ABSTRACT

The present invention relates to a feed unit of a detergent composition containing one or more surfactants, an alkali carbonate, and an acid which forms water-soluble calcium salts and magnesium salts and/or complexes, and in which detergent composition the acidic constituent and the alkaline constituent are separately present, the acidic constituent having a higher rate of solubility in a wash liquor than the alkaline constituent, and the total amount of alkali being present in excess relative to the amount of acid.

The invention is characterized in that the feed unit comprises a sachet which entirely or partly consists of a material permeable to or disintegrating in water and is filled with the acidic and the alkaline constituent, the acidic constituent containing 5-30 percent by weight, calculated on the total amount of detergent composition, of an acid having a $pK_1$ value in the range of 2.8 to 4.8.

It is preferred that the sachet should have 2 compartments, the acidic constituent being contained in the one compartment and the alkaline constituent in the other compartment.

7 Claims, No Drawings

FEED UNIT OF A DETERGENT COMPOSITION BASED ON ALKALI CARBONATE

The present invention relates to a feed unit of a detergent composition containing one or more surfactants, an alkali carbonate, and an acid which forms water-soluble calcium salts and magnesium salts and/or complexes, and in which detergent composition the acidic constituent and the alkaline constituent are separately present, the acidic constituent having a higher rate of solubility in a wash liquor than the alkaline constituent, and the total amount of alkali being present in excess relative to the amount of acid.

A feed unit of the type indicated above is known from the U.S. Pat. No. 3,761,415. Said patent specification describes a phosphate-free detergent composition in the form of a tablet consisting of a substance such as citric acid which when in solution releases citrate ions, and an alkali carbonate and a synthetic surfactant. The tablet described comprises an outer layer of the source of citrate ions and an inner body of alkali carbonate.

In essence, the citrate ions go into solution before the sodium carbonate and in such an amount that the formation of water-insoluble calcium carbonates and magnesium carbonates is inhibited.

Disadvantages to the tablet described are that it dissolves relatively slowly and comes into direct contact with the washing. This direct contact may give rise to fibre damage and discoloration of the washing. This disadvantage is found especially with the above-mentioned detergent composition because it contains a relatively high percentage by weight of citric acid.

At a German Hardness of 6° the wash liquor should preferably contain 0.5 percent by weight of citric acid and 1.0 percent by weight of alkali carbonate. Converted for a feed unit, the detergent compositions given in the examples contain 33 to 57 percent by weight of citric acid. Also for reasons of economy, partly because of the relatively high cost price of citrates and citric acid, such a percentage is unacceptably high. Moreover, even at low initial hardness values the remaining hardness appears to be relatively high, which for instance unfavourably affects the envisaged cleaning effect.

The feed unit according to the invention does not show these drawbacks and is characterized in that the feed unit comprises a sachet which entirely or partly consists of a material permeable to and disintegrating in water and is filled with the acidic and the alkaline constituent, the acidic constituent containing 5–30 percent by weight, calculated an total amount of detergent composition, of one or more acids having a $pK_1$ value in the range of 2.8 to 4.8.

The present invention provides a solution to the problem of excluding from detergent compositions those components that are (may be) harmful from an ecological point of view. As examples of such possibly harmful components may be mentioned the frequently employed sodium polyphosphate and other phosphates. Phosphates form an indispensable nutrient for vegetable and animal life. When present in high concentrations in stagnant or slowly flowing water, however, they may give rise to excessive growth of algae. One of its consequences is a decrease of the oxygen content in the deeper parts of the water, and anoerobic processes may cause the formation of gases such as methane and carbon disulphide. These phenomena may have a detrimental influence on fish-stock and may cause considerable damage to areas of natural beauty and recreation.

In view of the severity of the above problem there has in the last few years been an intensive search for suitable substitutes for phosphates in detergent compositions.

The phosphates are added to the detergents because they are capable for instance of binding calcium ions and magnesium ions to form soluble complexes. As a result, these ions can no longer form objectionable precipitates along with ingredients of the wash liquor or with dirt held by the fabric to be laundered. These precipates are objectionable in that they deposit on the laundered fabric. Substitutes for phosphate that have been proposed include oxidized polysaccharides, certain cellulose derivatives, citrates, nitrilotriacetates and water-insoluble sodium alumino-silicates.

Total replacement of phosphates has so far been realized only on a limited scale.

According to the invention the above problem can be solved in an inexpensive way by the use of a detergent composition based on alkali carbonate. The conventional detergent compositions based on alkali carbonate have the disadvantage that in successive washing cycles they give rise to considerable growth of water-insoluble carbonates on the fabric being cleansed. This drawback is still aggravated in that such incrustation is cumulative and may increase more than proportionally as a function of the number of washing cycles. As a result, the quality of the fabric treated with these compositions will be affected and the fabric will display little absorption power and have a stiff and hard handle; moreover, wear and discoloration will occur.

Besides, as a result of aging, the carbonate precipitate will become more and more difficult to dissolve.

It has been found, however, that in one washing cycle so little fabric incrustation occurs that the above-mentioned drawbacks are not met. The use of a feed unit of the detergent composition according to the invention results in the fabric incrustation formed in one washing cycle being brought into solution at the beginning of the next washing cycle by a reaction with acid under mildly acid conditions. The mildly acid conditions should be maintained sufficiently long to allow the precipitated carbonates to practically completely dissolve.

Subsequently, as a result of the alkaline constituent going into solution, the wash liquor is softened. For the presence of the alkali carbonate in the water causes the calcium ions and the magnesium ions contained in the wash liquor to be precipitated as water-insoluble carbonates. For maximum softening and optimum washing effect the pH of the wash liquor, after almost complete dissolution of the alkaline constituent, should have a value in the range of 9.0 to 10.5. Application of the present invention prevents appreciable growth in a fabric of insoluble carbonates or other salts.

The use of a sachet on the one hand leads to avoiding direct contact between the acid and the washing and on the other hand makes it possible for the detergent composition to be brought into a form in which both the acidic and the alkaline constituent sufficiently rapidly dissolve in the wash liquor. Moreover, a feed unit of the detergent composition according to the invention need contain only a relatively small percentage of acid. It should be added that the German Patent Specification No. 2 437 173 describes a process which comprises successive treatments with an acidic pre-wash detergent composition and an alkaline mainwash detergent composition based on sodium carbonate. The present invention has the advantage over that according to said German Patent Specification No. 2 437 173 that the envisaged prevention of appreciably cumulative incrustation is realized by the use of a single detergent composition. Moreover, with the feed unit according to the invention direct contact is avoided between the detergent composition and the washing, at least as far as the acidic constituent is concerned.

Moreover, when use is made of the present detergent composition is is unnecessary and mostly even undesirable for the wash liquor entirely or largely to be drained off between the acid and the alkaline phase of the washing process. The acid contained in the acidic constituent should be capable of forming calcium salts and magnesium salts and/or complexes that are moderately to well soluble in water. The amount of acid should be sufficiently high to dissolve calcium carbonate and magnesium carbonate in a fabric. The required percentage by weight of acid is dependent, inter alia, on the acid used, the bicarbonate content and the hardness of the water employed for the washing treatment.

In practice it has been found that an amount of 5 to 30 percent by weight, calculated on the total amount of detergent composition, is sufficient.

The acidic constituent should dissolve to such an extent in the wash liquor that within 5 minutes and preferably within 2 minutes after the detergent composition has been added the wash liquor has a pH in the range of 2.0 to 5.0.

Should the pH drop to below 2.0, then certain types of fibres may be damaged. On the other hand, a pH above 5.0 would in practice result in the carbonate taking too long to completely dissolve. The $pK_1$-value of the acid should be in the range of 2.8 and 4.8. Should the acid have $pK_1$-value below 2.8, then the pH of the wash liquor may temporarily drop to below 2.0, whereas a $pK_1$-value above 4.8 would in practice call for the use of uneconomically large amounts of acid in order to attain a pH below 5.0.

The alkaline constituent should not dissolve until the fabric incrustation formed in the previous wash cycle has gone into solution. In actual practice this means that the alkaline constituent should dissolve in the wash liquor only after at least 2 and not more than 10 minutes and preferably after at least 3 and not more than 6 minutes.

The acidic and the alkaline constituent should be separately present in the detergent composition. To this end it is only required that the two constituents can be separately distinguished. This requirement consequently does not exclude the two constituents from being in contact with each other.

The detergent composition is brought into the form of a feed unit comprising a sachet entirely or partly made of a material permeable to or disintegrating in water and filled with the acidic and the alkaline constituent. In this way the acid is prevented from getting into contact with the washing before it dissolves. As a result, even the slightest chance of fibre damage and discoloration of the washing is avoided. A sachet is filled with an amount of detergent composition which is sufficient for one washing cycle. The filled sachet can therefore be brought into the wash liquor as such. Such a sachet may consist of a material which does not disintegrate in water and is closed with a strip of material which does disintegrate in water. Alternatively, the sachet may be closed by means of seams filled with a material that disintegrates in water. As examples of suitable materials that do not disintegrate in water may be mentioned polyethylene, polypropylene and polyvinyl chloride. To close the sachet use may be made of water-dispersible paper. By preference, however, the sachet consists entirely or partly of a non-woven material. This material is permeable to water and relatively strong.

The acidic constituent should contain 5–30 percent by weight, calculated on the total amount of detergent composition, of an acid having a $pK_1$ value in the range of 2.8 to 4.8.

As examples of acids which have these properties may be mentioned adipic acid, succinic acid, citric acid, diglycolic acid, glycolic acid, glutaric acid, fumaric acid, lactic acid and tartartic acid.

The acidic constituent may, of course, also contain a mixture of acids. By preference the acidic constituent should then be a mixture of adipic acid, glutaric acid and succinic acid. It has been found that such a mixture very rapidly dissolves and moreover very favourably influences the rate of solubility of the precipitated carbonates during the acid phase of the washing process.

If the acidic constituent contains a mixture of acids, then at least one acid should have a $pK_1$-value in the range of 2.8 to 4.8. such an acid may be mixed with inorganic acids such as sodium bisulphate. In combination with other acids use may also be made of polycarboxylic acids, such as polyacrylic acid, the acid form of oxidized cellulose and starch, mono- and polycarboxylated products obtained by substitution of hydrogen atoms of starch and cellulose, such as carboxymethyl cellulose and dicarboxymethyl starch.

Depending on the envisaged application of the detergent composition one or more conventional components may be incorporated into the acidic constituent.

By preference the acidic constituent contains a surfactant. Its presence results in the acids, the washing and the precipitaed carbonates being wetted more rapidly, which favourably influences the rate of solubility of the carbonates. Particularly suitable for this purpose are ethoxylated fatty alcohols.

Another category of materials that may be incorporated into the acidic constituent are per-compounds such as peroxides, which have an optimum bleaching effect at a pH lower than that at which the detergent composition displays optimum cleaning action. Also compounds such as peroxomonosulphate, which have insufficient storage stability in the usual detergent compositions, may be included in the acidic constituent. The alkaline constituent should contain such an amount of alkali that after the alkaline constituent has almost completely dissolved the pH of the wash liquor is 9.0–10.5. This pH is required for obtaining an optimum cleaning effect and effective softening. By preference, the alkali used is an alkali carbonate or a mixture of alkali carbonate and, for instance, sodium silicate. The alkali content may vary between wide limits. The detergent composition should however contain at least 5 percent by weight of alkali carbonate in order that the calcium ions and the magnesium ions may be precipitated in the wash liquor. A lower percentage would be ineffective even under the most favourable conditions. In some circumstances it may be desirable for the detergent composition to contain as much as 65 percent by weight of alkali carbonate. A suitable alkali carbonate is sodium carbonate. Sodium carbonate and its hydrates, however, are relatively sensitive to moisture. With the present detergent composition this may lead to difficulties in that this detergent composition contains an acidic as well as an alkaline constituent. Also the rather high alkalinity sometimes forms a drawback. For these reasons in addition to calcined sodium carbonate the alkaline constituent may be made to contain as alkali carbonate sodium bicarbonate and/or sodium sesquicarbonate. These combinations of compounds are less sensitive to moisture than sodium carbonate and also have a lower alkalinity.

Moreover, the alkaline constituent may contain one or more usual detergent components such as surfactants, builders, bleaching agents, fluorescent brighteners, enzymes, foaming agents, substances such as sodium carboxymethyl cellulose, which serve to prevent dirt from re-depositing on the fabric, bactericides, corrosion inhibitors, perfumes, colourants, etcetera.

As surfactants may be used the water-soluble salts of higher fatty acids ("soaps") or the synthetic surfactants described in, for instance, the British Patent Specifications Nos. 1 429 143 and 1 473 201.

It is preferred that the surfactant contained in the alkaline constituent should be an alkyl ether sulphate. Alkyl ether sulphates have the advantage that they contribute to reducing incrustation. Preferably use is made of sodium tallow fatty alcohol ether sulphate.

The retarded dissolution of the alkaline constituent may be obtained in various ways.

For example, use may be made of known shaping techniques, which are grouped here under the generic name of agglomeration techniques. By agglomeration techniques are to be understood, inter alia, pelletizing, tabletting, granulating, extruding, marumerizing, briquetting, rolling followed by cutting. In this way also the surface area of the alkaline constituent is drastically reduced, which is of course of importance for the present invention.

The most important parameters influencing the rate of solution are the composition of the alkaline constituent, the shaping method and the shaping pressure that may be used. It is preferred that the alkaline constituent should be provided with a coating which disintegrates only after at least 2 and at most 10 minutes and preferably after at least 3 and at most 6 minutes. By disintegration are to be understood here, inter alia, dissolution and dispersion. The amount of coating material to be used is 0.1–15, and preferably 0.5–10 percent by weight, calculated on the total amount of detergent composition.

As coating material may be used any material known to be employed for the present purpose.

As examples of suitable water-soluble or water-dispersable polymers may be mentioned polyethylene glycols, polyvinyl alcohol, polyvinyl pyrrolidone, polyvinyl acetate, carboxymethyl cellulose, carboxymethyl starch, hydroxypropyl cellulose, gelatin, arabic gum, etcetera, provided that they are applied in a sensible manner.

Excellently suitable are (co)polymers of methacrylic acid and methacrylicc esters, available under the trade names Eudragit L 30 D and E 30 D.

It is preferred that the feed unit should be given a form such that there is no direct contact between the acidic and the coated or non-coated, alkaline constituent.

To that end it is preferred that a feed unit of the detergent compositin should be brought into a form such that the sachet has two compartments, the acidic constituent being contained in the one and the alkaline constituent in the other compartment. Such a feed unit comprises for instance a sachet consisting of 2 non-woven outer walls and a polyethylene partition wall, the one compartment being filled with a powdered acidic constituent and the other component with a coated alkaline constituent. The seams of these sachets may be sealed with a glue or by using pressure at elevated temperature.

Or the sachets may be so formed that the alkaline constituent goes into retarded dissolution as a result of the construction of the sachet.

The use of such sachets has the advantage that the alkaline constituent may be contained in the sachet in the form of powder. To that end a sachet may be made of which the compartment containing the alkaline constituent (the "alkaline" compartment) entirely or partly consists of a material which becomes permeable to water or disintegrates in it only after at least 2 and not more than 10 minutes and preferably after at least 3 and not more than 6 minutes.

By disintegration is also to be understood here tearing of the sachet. A sachet may in principle consist of, for instance, 3 layers of material, the outer wall of the "acidic" compartment being permeable to water, the outer wall of the alkaline "compartment" being impermeable to water and the partition wall for instance consisting of a mixture of poly(meth)acrylic acid (Eudragit L 30 D) polymethacrylic esters (Eudragit E 30 D) and polypropylene glycol, or a mixture of polymethacrylic esters (Eudragit E 30 D) and hydroxypropyl methyl cellulose. The water-permeable outer wall preferably consists of a non-woven material.

For the water-impermeable wall various materials may be used. By preference however use is made of polyethylene, polypropylene, polyvinyl chloride or a non-woven material provided with a water-insoluble coating.

Alternatively, the "alkaline" compartment may be closed with a strip which becomes permeable to water or disintegrates after at least 2 and not more than 10 minutes and preferably after at least 3 and not more than 6 minutes. Such a strip may be provided as connecting strip between an impermeable partition wall and outer wall. Such a strip may for instance entirely or partly consist of a mixture of polymethacrylic acid (Eudragit L 30 D), polymethacrylic esters (Eudragit E 30 D) and polypopropylene glycol, or of a mixture of polymethacrylic esters and hydroxypropyl methyl cellulose.

Alternatively, the alkaline compartment may be provided with one or more seams that open in water after at least 2 and not more than 10 minutes and preferably after 3 and not more than 6 minutes. A sachet of this type may be made by providing in the seams a material which disintegrates in water within the above-mentioned period.

For example, the seams of the sachet may entirely or partly be filled with a mixture of polyethylene glycol, one or more thermoplastic acrylic resins and highly disperse silicium oxide. The seams of such a sachet will open after 4–5 minutes at a wash temperature of 55° C.

The invention is further described in the following examples.

EXAMPLE 1 (Comparative)

The following bundle tests were carried out in a Wringer washing machine. The volume of the wash liquor was 50 liters, the water had a German Hardness of 7.5°. 2.95 kilogrammes of washing consisting of napkins, bath towels, tea towels and parts of bed sheets were washed 20 times. The washing tests were carried out both at room temperature and at 55° C. To the wash liquor there were added 83.4 grammes of a traditional detergent composition based on sodium carbonate. The detergent composition contained the following ingredients:

1.8 grammes of tallow fatty alcohol, 25 ethylene oxide
7.0 grammes of tallow fatty ether sulphate
5.0 grammes of sodium dodecyl benzene sulphonate
10.0 grammes of sodium disilicate
11.8 grammes of sodium carbonate
21.5 grammes of sodium bicarbonate
1.0 gramme of sodium carboxymethyl cellulose
23.0 grammes of sodium sulphate
2.3 grammes of water Of each type of washing the incrustation was determined before starting the washing tests, and after the 10th and the 20th washing cycles. Table I shows the results obtained after washing at room temperature. Table II gives the results obtained after washing at 55° C.

TABLE I

| Number of washing cycles | Percentage incrustation in the washing | | | | |
|---|---|---|---|---|---|
| | napkins | sheets | bath towels | tea towels | average |
| 0 | 0,19 | 0,21 | 0,42 | 0,21 | 0,26 |
| 10 | 0,63 | 0,54 | 1.02 | 1,01 | 0,80 |
| 20 | 1,19 | 1,08 | 1,72 | 1,54 | 1,38 |

TABLE II

| Number of washing cycles | Percentage incrustation in the washing | | | | |
|---|---|---|---|---|---|
| | napkins | sheets | bath towels | tea towels | average |
| 0 | 0,19 | 0,21 | 0,42 | 0,21 | 0,26 |
| 10 | 0,48 | 0,49 | 1,87 | 0,66 | 0,88 |
| 20 | 0,88 | 0,96 | 2,31 | 1,27 | 1,35 |

The above results show that when use is made of the traditional detergent compositions based on alkali carbonate, there will be considerable accumulation in the washing of insoluble calcium carbonates and magnesium carbonates.

EXAMPLE 2

The following washing tests were all carried out at 55° C. under the conditions described in Example 1. Instead of a traditional detergent composition based on alkali carbonate a feed unit of the detergent composition according to the invention was added to the wash liquor.

The feed unit comprised a 2-compartment sachet measuring 15×12 cm having an outer wall of the "alkaline" compartment of a laminated non-woven material, and an outer wall of the "acidic" compartment of a non-woven material and a partition wall of polyethylene. The seams were sealed with glue. On one side of the sachet a tear strip was provided between the outer wall of the alkaline compartment and the partition wall, which tear strip was about 0.07 mm thick and tore after 5 minutes at a wash liquor temperature of 55° C. The strip consisted of 5 parts of Eudragit E 30 D and 0.25 parts of Methocel H G 100 (hydroxyl propyl methyl cellulose).

The sachet was filled with 22.4 grammes of the acid constituent and 69.0 grammes of the alkaline constituent.

The acidic constituent was present in the form of extrudates having a diameter of 0.8 mm and a length of 1 to 3 mm; the alkaline constituent was present in the form of powder. The acidic constituent was made up of:

6.2 grammes of adipic acid
6.2 grammes of succinic acid
8.3 grammes of glutaric acid
1.7 grammes of tallow fatty alcohol, 25 ethylene oxide.

The alkaline constituent was made up of:

7.0 grammes of tallow fatty ether sulphate
5.0 grammes of sodium dodecyl benzene sulphonate
10.0 grammes of sodium silicate
39.0 grammes of sodium carbonate
1.0 gramme of sodium carboxymethyl cellulose
7.0 grammes of water During each washing cycle the pH of the wash liquor was measured after 5 and 15 minutes.

The results are shown in the following table.

TABLE III

| Number of washing cycles | pH after 5 minutes | pH after 15 minutes |
|---|---|---|
| 1 | 4,1 | 10,2 |
| 5 | 4,6 | 10,2 |
| 10 | 4,7 | 10,2 |
| 15 | 4,8 | 10,2 |
| 20 | 4,7 | 10,2 |

The relation between pH of the wash liquor and time during the 20th washing cycle is given in the following Table IV.

TABLE IV

| Time (in minutes) | pH |
|---|---|
| 2 | 4,7 |
| 4 | 4,7 |
| 5 | 4,7 |
| 6 | 10,2 |
| 8 | 10,2 |
| 15 | 10,2 |

Also in these washing tests the incrustation was determined before starting the washing tests, and after the 10th and the 20th wash cycles. The results are given in the following Table V.

TABLE V

| Number of washing cycles | Percentage incrustation in washing | | | | |
|---|---|---|---|---|---|
| | napkins | sheets | bath towels | tea towels | average |
| 0 | 0,19 | 0,21 | 0,41 | 0,21 | 0,26 |
| 10 | 0,8 | 0,12 | 0,42 | 0,23 | 0,21 |
| 20 | 0,18 | 0,17 | 0,43 | 0,31 | 0,27 |

The above bundle test shows that use of the present invention hardly leads to any incrustation It also appeared that the primary cleaning effect of the detergent composition according to the invention compares with that of the phosphate-containing detergent compositions. No fibre damage was found. Nor did the washing show any appreciable discoloration.

EXAMPLE 3

In the following bundle test use was made of a feed unit as described in Example 2, except that the tear strip consisted of 3.75 parts of Eudragit E 30 D and 0.30 parts of Methocel 90 H G 100 (hydroxypropyl methyl cellulose). The washing tests were carried out at room temperature and further under the same conditions as described in Example 1. Table VI gives the pH values measured during the washing cycles after 5 and 15 minutes.

TABLE VI

| Number of washing cycles | pH after 5 minutes | pH after 15 minutes |
|---|---|---|
| 1 | 4,3 | 10,4 |
| 5 | 4,6 | 10,1 |
| 10 | 4,7 | 10,4 |
| 15 | 4,7 | 10,2 |
| 20 | 4,7 | 10,1 |

The relation between pH of the wash liquor and time during the 20th washing cycle is given in Table VII.

TABLE VII

| Time in minutes | pH |
|---|---|
| 2 | 4,8 |
| 4 | 4,7 |
| 5 | 4,7 |
| 6 | 10,1 |
| 8 | 10,2 |
| 15 | 10,2 |

Table VIII gives the incrustation values measured before starting the washing tests, and after the 10th and the 20th washing cycles.

TABLE VIII

| Number of washing cycles | Percentage incrustation in washing | | | | |
|---|---|---|---|---|---|
| | napkins | sheets | bath towels | tea towels | average |
| 0 | 0,19 | 0,21 | 0,41 | 0,21 | 0,26 |
| 10 | 0,16 | 0,16 | 0,33 | 0,22 | 0.22 |
| 20 | 0,10 | 0,10 | 0,38 | 0,16 | 0,19 |

The above data confirm the results described in Example 2.

EXAMPLE 4

The bundle tests described in the Examples 2 and 3 were repeated, use being made of the same procedure with the only exception that the acidic constituent was in the form of a powder and consisted of 18.3 grammes of fumaric acid, and 1.7 grammes of tallow fatty alcohol, 25 ethylene oxide. Table IX gives the pH values measured during the washing cycles both at a wash temperature of 55° C. and at room temperature.

TABLE IX

| Number of washing cycles | Wash Temperature: 55° C. | | Wash Temperature: room temp. | |
|---|---|---|---|---|
| | pH after 5 min. | pH after 15 min. | pH after 5 min. | pH after 15 min. |
| 1 | 3,4 | 10,3 | 3,5 | 10,3 |
| 5 | 4,0 | 10,2 | 4,1 | 10,2 |
| 10 | 4,1 | 10,2 | 4,1 | 10,1 |
| 15 | 4,2 | 10,1 | 4,2 | 10,2 |
| 20 | 4,2 | 10,2 | 4,1 | 10,2 |

The relation between pH of the wash liquor and time during the 20th washing cycle is given in the following table X.

TABLE X

| Time in minutes | pH (55° C.) | pH (room temperature) |
|---|---|---|
| 2 | 4,2 | 4,2 |
| 4 | 4,2 | 4,1 |
| 5 | 4,2 | 4,1 |
| 6 | 10,1 | 10,2 |
| 8 | 10,2 | 10,2 |

TABLE X-continued

| Time in minutes | pH (55° C.) | pH (room temperature) |
|---|---|---|
| 15 | 10,2 | 10,2 |

The average incrustation figures measured before starting the washing tests, and after the 10th and the 20th washing cycles are given in the following table XI.

TABLE XI

| Number of washing cycles | Percentage incrustation in washing | |
|---|---|---|
| | 55° C. | room temperature |
| 0 | 0,26 | 0,26 |
| 10 | 0,20 | 0,21 |
| 20 | 0,25 | 0,22 |

EXAMPLE 5

A feed unit according to the invention comprised a non-woven sachet of 12×13 cm having only one compartment and filled with 91.4 grammes of a detergent composition. The powdered acidic constituent had the same composition as the one in Example 2, and the alkaline constituent was formed into spherical particles of an average diameter of about 1 mm by extruding and marumerizing.

These spherical particles were coated with 2.5% by weight of Eudragit E 30 D and 10% by weight of Eudragit L 30 D. The amount of coating material was 9.4% kg weight, calculated on the total amount of detergent composition.

A washing test was carried out under the conditions described in Example 1.

The following table shows the relationship between pH and time during the first washing cycle. The wash liquor temperature was 55° C.

TABLE XII

| time in minutes | pH |
|---|---|
| 1 | 4,2 |
| 2 | 4,3 |
| 3 | 5,0 |
| 4 | 6,5 |
| 5 | 9,0 |
| 6 | 10,1 |
| 8 | 10,2 |
| 10 | 10,2 |

After 10 and 20 wash cycles the average incrustation values were 0.23% and 0.28%, respectively.

The above data show that a satisfactory feed unit of the detergent composition according to the invention can also be obtained in the above-described way.

What is claimed is:

1. A sachet having two compartments containing a detergent composition comprising:

(a) 5–65 percent by weight of an alkali carbonate;

(b) 5–30 percent by weight of one or more solid acids which form water-soluble calcium salts and magnesium salts or complexes, the acids having a $pK_1$-value in the range of from 2.8 to 4.8;

(c) the remainder of the composition consisting of usual solid detergent constituents including surfactants and optionally including alkaline builders; the total amount of alkaline material being present in stoichiometric excess relative to the amount of the acid, the acid being present in one of the compartments and the alkaline constituents being present in the other compartment of the sachet, the compartment containing the acid releasing its contents when brought into water before the compartment containing the alkaline constituent releases its contents.

2. A sachet according to claim 1, characterized in that it entirely or partly consists of a non-woven material.

3. A sachet according to claim 1, characterized in that the compartment containing the alkaline constituents partly or entirely consists of a material which becomes permeable to water or disintegrates in it only after at least 2 and at most 10 minutes.

4. A sachet according to claim 3, characterized in that the compartment in which the alkaline constituent is present entirely or partly consists of polymers or copolymers of methacrylic acid and/or methacrylic esters.

5. A sachet according to claim 3, characterized in that the compartment containing the alkaline constituent partly consists of hydroxypropyl methyl cellulose.

6. A sachet according to claim 1, characterized in that the compartment containing the alkaline constituents is provided with one or more seams which open in water after at least 2 and at most 10 minutes.

7. The product of claim 1 wherein said first compartment has at least one seam which opens in water and which contains a mixture comprising polyethylene glycol and a thermoplastic resin.

* * * * *